United States Patent [19]

Bullard

[11] Patent Number: 4,991,570

[45] Date of Patent: Feb. 12, 1991

[54] VACUUM TEETH CLEANING SYSTEM AND METHOD

[76] Inventor: Horace Bullard, 3333 Henry Hudson Pkwy., Riverdale, N.Y. 10463

[21] Appl. No.: 361,926

[22] Filed: Jun. 6, 1989

[51] Int. Cl.[5] ..... A61H 9/00

[52] U.S. Cl. ..... 128/66; 433/91

[58] Field of Search ..... 433/91, 92; 128/66, 128/62 A

[56] References Cited

U.S. PATENT DOCUMENTS

| | | | |
|---|---|---|---|
| 3,146,478 | 9/1964 | Rosenthal | 128/62 A |
| 3,211,149 | 10/1965 | Fono | 128/66 |
| 3,379,192 | 4/1968 | Warren, Jr. | 128/66 |
| 3,401,690 | 9/1968 | Martin | 128/66 |
| 3,452,746 | 7/1969 | Shanhouse | 128/66 |
| 3,731,675 | 5/1973 | Kelly | 128/62 A |
| 4,672,953 | 6/1987 | DiVito | 128/66 |

*Primary Examiner*—John J. Wilson

*Attorney, Agent, or Firm*—Eliot S. Gerber

[57] ABSTRACT

A system for cleaning of teeth and gums and removing food particles from between the teeth includes a motor driven suction pump and a source of liquid. A clamp means forms an air-tight chamber over a few of the teeth at a time and includes two clamp members, each having a cavity with bristles. A vacuum is applied from the suction pump to one clamp member and draws liquid to the other clamp member and through the enclosed teeth.

5 Claims, 2 Drawing Sheets

VACUUM TEETH CLEANING SYSTEM AND METHOD

BACKGROUND OF THE INVENTION

1. Field of the Invention

The present invention relates to dentistry and more particularly to a method and system for cleaning the teeth and gums.

2. Description of the Related Art

At the present time, generally a person will clean his or her teeth daily using a toothbrush having bristles, and a dentifrice. Another type of tooth cleaning system uses a head having small rotating pins which also project streams of water. In addition, dental floss and toothpicks are often used for cleaning between the teeth.

Although most people are reasonably conscientious concerning their dental (oral) hygiene and brush at least once a day, the incidence of gum disease, specifically periodontal disease, is very common. It is believed that peridontal disease is the major cuase of dental problems, including teeth loss, in the the adult population.

Periodontal disease (pyorrhea) is caused by bacteria and affects the tissues housing the roots of the teeth. The best prevention and treatment is to remove plaque and food residues especially from between the teeth and in the region between the loose gum and the teeth, i.e., the gingival sulcus. Gingivitis is a form of periodontal disease in which the gum tissue (gingival) is affected and periodontitus is the form in which the inflammatory region reaches deeper structure.

Although careful oral hygiene is so important in the prevention of periodontal disease, often the only daily hygiene is to brush the teeth using a toothbrush. However, brushing alone is not sufficient to remove food residue particles and plaque from between the teeth and under the loose gum flap, i.e., from the gingival sulcus.

In U.S. Pat. No. 3,566,869 a mouthpiece fits over all the teeth of the user. Liquid dentrifice is continuously sprayed through fine holes onto all the teeth simultaneously and the liquid is sucked out by vacuum through a tube. There is no suction of liquid through gaps in the teeth.

In U.S. Pat. No. 3,134,127 air and possible a liquid, under pressure, are sprayed on the teeth and the liquid is removed by suction. The air and suction heads do not form an air-tight chamber on the teeth.

OBJECTIVE AND FEATURES OF THE INVENTION

It is an objective of the present invention to provide a system and method for the cleaning of teeth in which the food particles will be more completely removed from between the teeth and from the gum region compared to using a toothbrush.

It is a further objetive of the present invention that such cleaning of the teeth is painless and may be about as fast as brushing with a toothbrush.

It is a further objective of the present invention that such cleaning of the teeth would remove sufficient food residue to help prevent and treat periodontal disease.

It is a further objective of the present invention that such cleaning of the teeth may be accomplished at home by the ordinary user without the requirement of special or extended training.

It is a further objective of the prevent invention that such cleaning of the teeth may be accomplished using the system of the present invention which is relatively simple to operate, relatively reasonable in cost and which is durable, safe and reliable.

It is a feature of the present invention to provide a system and method for the cleaning of teeth. The system includes a vacuum means to create a vacuum, such as motor driven suction pump, and a source of liquid which is pulled by the vacuum through gaps between the teeth. The liquid source may be a container of water or mouthwash.

A clamp means forms an air-light chamber over at least two teeth. The clamp means comprises a first clamp member which fits on the front of the teeth and a second clamp member which fits on the back of the teeth. A vacuum line leads from the vacuum means to one clamp member and a liquid line leads from the liquid source to the otherclamp member. A control means, such as a solenoid-operated air valve, is connected to the vacuum line in order to intermittently apply vacuum from the vacuum means to the clamp means and to thereby pull liquid from the liquid source through the gaps between teeth.

SUMMARY OF THE INVENTION

In accordance with the present invention, there is provided a system and method to clean teeth which relies upon the vacuum force to pull a jet of water through the gaps between the teeth. The system includes a source of vacuum, preferably a small electrically driven vacuum pump, a tube to the vacuum source, a source of liquid, preferably a container of water or mouthwash, a switch operated solenoid valve which closes and opens a tube to the liquid container, and a special air-tight tooth clamp. The clamp is operated by the user so that one clamp member fits on one side of a few teeth and an opposite clamp member fits on the other side of those teeth. The clamp members form an air-tight chamber which is moved along the teeth. A flexible vacuum tube leads to one clamp member and a flexible liquid tube leads to the opposite clamp member. The vacuum pulls food residue from the gum area. In addition, when the switch is activated, or automatically intermittently, the valve is opened and the vacuum pulls liquid from the container and through the gaps between the teeth, thereby removing food residue from the teeth.

BRIEF DESCRIPTION OF THE DRAWINGS

Other objectives and features of the present invention will be apparent from the following detailed description taken in conjunction with the accompanying drawings. In the drawings.

DETAILED DESCRIPTION

Figure 1:
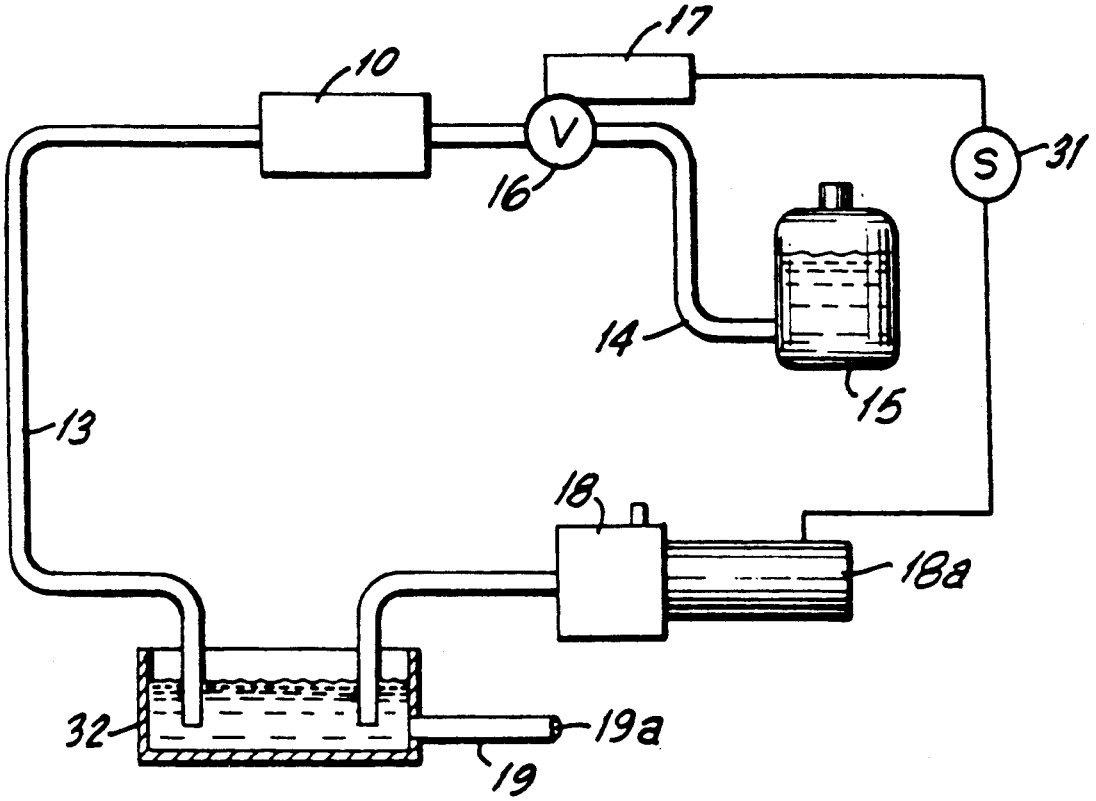
FIG. 1 is a block diagram of the system of the present invention.
Figure 2:
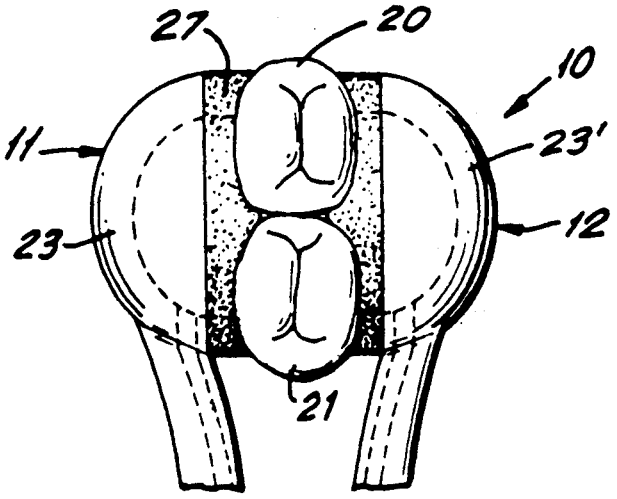
FIG. 2 is a top plan view of one embodiment of the clamp means.

As shown in FIGS. 1 and 2, the system of the present invention is intended to apply a vacuum to a small air-tight chamber. The clamp means is moved along the teeth and the clamp members 11 and 12 are momentarily brought together over a pair of teeth. Alternatively, the clamp means may span three or four teeth. One clamp member 11 is on the front of the teeth and the opposite clamp member 12 is on the back of the teeth.

A flexible tube, preferably a reinforced rubber tube 13 (hose) of one-eighth inch inner diameter, is connected to the clamp member 11. A second flexible rubber tube 14, of the same size, is connected to the water solution container 15 (source of liquid) which may be a mouthwash or plain water. The tubes 13 and 14 are sufficiently thick or reinforced so that they do not collapse under the vacuum of the system . An electrically operated solenoid valve 16 is positioned in line 14 between the container 15 and the clamp member 12.

The electromechanical valve 16 is normally closed, i.e., the line 14 is normally closed. The valve is preferably operated intermittently by timer 17, for example, once per second. Alternatively, the valve 16 is operated to open line 17 by a switch which is operated by the user.

The tube 13 leads to a source of vacuum, preferably a suction (vacuum) pump 18. The vacuum applied is in the range of 20 inches of mercury (sea level). That is a relatively low vacuum and may be obtained using a suction pump operated by an electrical fractional horsepower motor **18*a*, for example, 1/16 H.P. A waste tube 19 (waste line) leads from the waste liquid container 32. The orifice 20 of tube 19** may be placed in a sink.

Alternatively, and not shown, a vcuum pump may be used which sucks both the liquid and air through the pump, thereby eliminating the liquid container 32.

Figure 3:
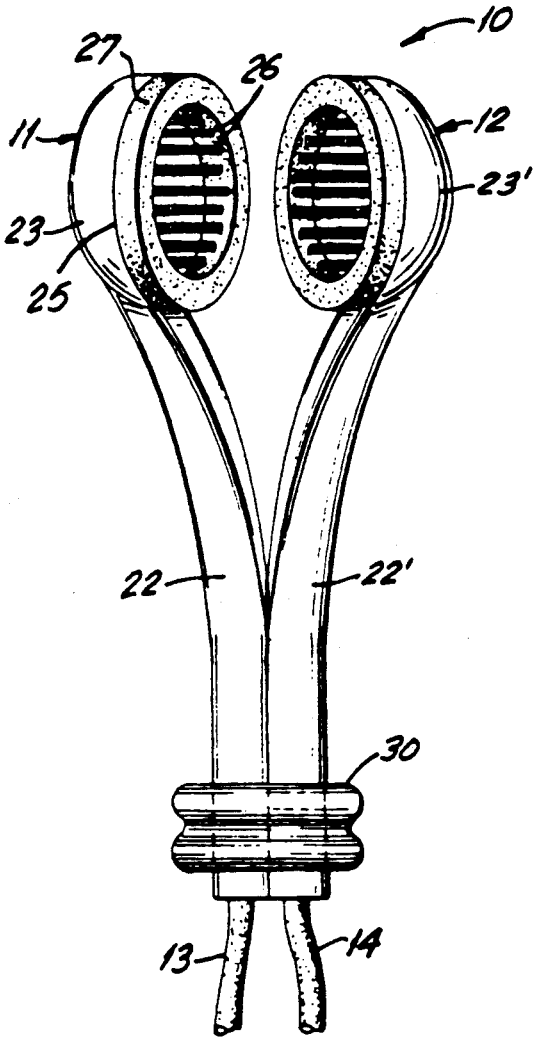
FIG. 3 is a perspective view of the clamp means of FIG. 2.

As shown in FIGS. 2 and 3, the clamp means 10 forms an air-tight chamber around two teeth 20 and 21. The clamp means 10 consists of first and second clamp members 11 and 12, respectively, which are constructed the same. The clamp member 11 has, as integral portions, a plastic resin handle portion 22 and a head portion 23. The head portion 23 is cup-shaped and has a cavity (depression) 24 and an edge 25. The wall of the cavity has protruding bristles 26 of the type use of toothbrushes. A flexible rubber oval-shaped ring 27 is secured to the edge 25 by an adhesive and forms a resilient seal with the teeth 20, 21.

A ring-like plastic member 30 is positioned over the handle portions 22,22' and urges the clamp members together, i.e., helps clamp members 11,12 on the teeth.

In operation, the user pushes switch 31 which starts the pump 18 and timer 17. He then places the heads 23,23' over the teeth 20,21, to form an air-tight chamber on the teeth. The pump will pull liquid from container 15, through tube 14, head 23', the gaps in the teeth, head 23, tube 13 and out of waste tube 19.

The user will then continue to push the clamp means and move the clamp heads 23,23' over two other teeth and repeat the cleaning process.

Figure 4:
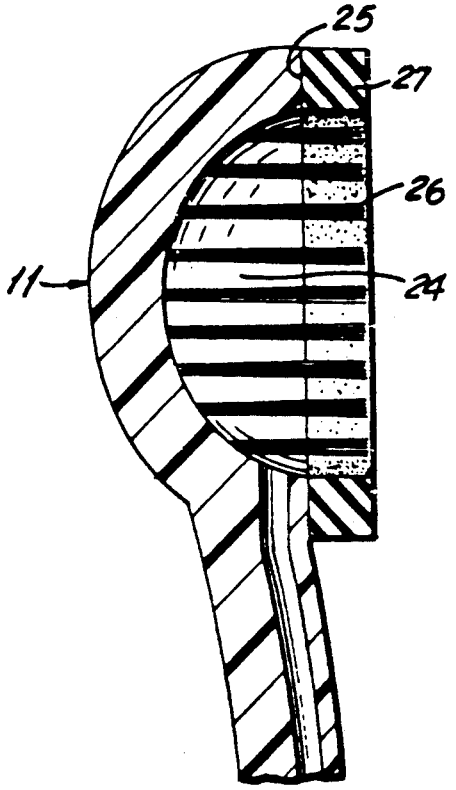
FIG. 4 is an enlarged cross-sectional view of a portion of the clamp means of FIG. 2.
Figure 5:
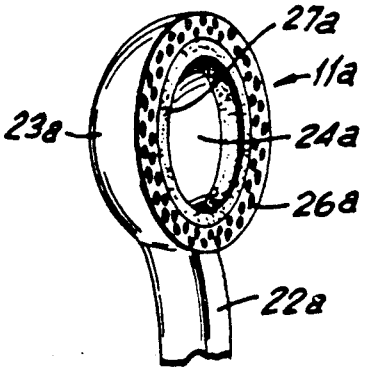
FIG. 5 is a perspective view of an alternative clamp head member.

An alternative clamp member **11*a* is shown in FIG. 5. In this embodiment the handle portion 22*a* is the same as handle portion 22 in the embodiment of FIGS. 3 and 4. However, the head portion 23*a* has the bristles 26*a* in a ring outside of the flexible soft rubber lip ring 27*a*. The ring 27*a* surrounds a cavity 24*a*** through which the vacuum is applied.

I claim:

1. A system for cleaning a set of teeth comprising:

(a) vacuum means to create a vacuum;

(b) a source of liquid to be pulled by the vacuum through gaps between the teeth;

(c) a clamp means to removably form an air-tight chamber over at least two teeth; said clamp means comprising a first clamp member to fit on the back of the teeth and a second clamp member fit on the front of the teeth;

(d) a vacuum line leading from the vacuum means to one clamp member;

(e) a liquid line leading from the liquid source to the other clamp member;

(f) control means connected to said vacuum line to intermittently apply vacuum from said vacuum means to said clamp means and to thereby pull liquid from said liquid source around the teeth within said chamber.

wherein each of said clamp members is a cup-like member having a cavity adapted to face said teeth and each includes a plurality of bristles within said cavity, said bristles having free ends adapted to contact said teeth.

2. A system for cleaning a set of teeth as in claim 1 wherein said vacuum means includes an electrically powered motor driven vacuum pump.

3. A system for cleaning a set of teeth as in claim 1 wherein said source of liquid is a refillable container.

4. A system for cleaning a set of teeth as in claim 1 wherein said first and second clamp members each includes a circumferential lip and resilient seal material connected at each of said lips to form resilient lips which are adapted to seal said clamp members with said teeth.

5. A system for cleaning a set of teeth as in claim 1 wherein said vacuum means creates a vacuum in the range of 20 inches of mercury at sea level.

* * * * *